United States Patent [19]

John

[11] 4,419,650

[45] Dec. 6, 1983

[54] LIQUID CONTACT RELAY INCORPORATING GAS-CONTAINING FINELY RETICULAR SOLID MOTOR ELEMENT FOR MOVING CONDUCTIVE LIQUID

[75] Inventor: Frank T. John, Williamsville, N.Y.

[73] Assignee: Georgina Chrystall Hirtle, Springville, Calif.

[21] Appl. No.: 69,249

[22] Filed: Aug. 23, 1979

[51] Int. Cl.[3] ..... H01H 61/00

[52] U.S. Cl. ..... 337/119; 337/122; 335/49; 200/185; 200/192; 423/445; 264/29.1

[58] Field of Search ..... 335/47, 48, 49, 50, 335/57; 337/114–115, 117–119, 121, 122; 200/182–186, 190–192; 423/445; 264/29.1

[56] References Cited

U.S. PATENT DOCUMENTS

| | | | |
|---|---|---|---|
| 3,176,101 | 3/1965 | Awender et al. | 337/119 |
| 3,579,168 | 5/1971 | Vary | 337/121 X |
| 3,806,855 | 4/1974 | Hurtle | 337/121 X |
| 4,103,135 | 7/1978 | Gomez et al. | 200/185 |
| 4,208,643 | 6/1980 | Snaper et al. | 335/49 X |

*Primary Examiner*—George Harris
*Attorney, Agent, or Firm*—Raymond F. Kramer

[57] ABSTRACT

It has been discovered that electrically conducting, vitreous pyrolytic carbon in broken-bubble, foam-type, reticulated structures can be used as an extremely fast and efficient electrically operated motor to actuate mechanical devices, such as mercury liquid contact relays, by electrothermally-produced gas expansion. The gas pressure change is produced evenly and almost instantaneously throughout the volume of the reticular motor to move mercury contacts, to open or close a liquid contact relay, thus avoiding the expensive electromagnetic coils now used as relay motors.

By passing an electrical current through conducting reticulated material formed from pyrolytic carbon, metals, conductive ceramics or plastics, the microscopic network of interconnecting filaments is heated, thus heating and expanding the fluid (air, hydrogen, helium, argon, etc.) contained in the reticular motor.

The time required to operate the device depends on the thermal gradient and the square of the average thermal diffusion distance between the gas and the nearest heating filament. Since the diffusion distance is very small, the device is very fast and efficient. For fast repetative motor operation, a reticulated material of high thermal conductivity such as silver, silicon nitride, or boron nitride, is sealed to the inside walls of the motor.

The reticular electrothermal motor is useful for operating mechanical devices including both miniature logic relays and large industrial relays. The high power requirement of the latter may be supplied by using change of state expansion of volatilizable liquids such as are used as refrigerants or as propellants in aerosol spray containers.

38 Claims, 11 Drawing Figures

LIQUID CONTACT RELAY INCORPORATING GAS-CONTAINING FINELY RETICULAR SOLID MOTOR ELEMENT FOR MOVING CONDUCTIVE LIQUID

This invention relates to an electric relay and a motor for actuating it. More particularly, the invention is of a liquid contact relay in which a conductive reticular material, upon passage of electricity through it, heats and expands a gas therein to create a pressure that moves a conductive liquid, such as mercury, to make or break an electrical contact.

Relays are widely used in various types of electrical equipment. Most of them operate by generating a magnetic field by flowing electric current through a "primary" circuit to cause movement of a magnetic switching element by the field. Such relays usually require many windings of an insulated conductor, such as copper wire, about a magnetic core and depend on mechanical movement of a switch part in response to the magnetic field generated. Thus, they are comparatively expensive, require the use of large quantities of copper and may be subject to jamming when the movable element becomes misaligned or wedged in position, which sometimes may occur due to foreign matter being present alongside the intended path of movement. In addition to these disadvantages, the conventional electromagnetic relays often include contacts that are subject to burning out in use. Often they do not operate satisfactorily in all positions, being less responsive when movement of the switching part is upward, due to the additional weight to be lifted against gravity, and sometimes being too readily movable downwardly, with gravity. Therefore, return springs will often be required and jammings of the movable parts may also occur during such return movements.

Because of the complexity, expense and oftentimes unsatisfactory operating characteristics of the conventional electromagnetic relays, efforts have been made to invent and develop relays that would be inexpensive, trouble-free and satisfactorily operative in different gravitational orientations. Liquid contact relays, using mercury as the conductive liquid, have been described in the patent art and such relays and switches have been manufactured and sold. Exemplary of patents on mercury or other liquid contact relays and switches are U.S. Pat. Nos. 2,577,653; 3,102,179; 3,176,101; 3,271,543; and 4,076,972. These patents illustrate conductive liquid switching or relay operations in response to gas pressure, which may be generated by resistance heating means. Although the conductive liquid, such as mercury, makes an excellent renewable contact surface switch part or element, often the resistance wire heaters used are not considered to be satisfactory. Unless heated to higher temperatures they may not heat the gas about them quickly enough and if heated to higher temperatures there may be a tendency for the resistance elements and/or their contacts with lead wires to become corroded or embrittled, so that they can fail. Also, to obtain greatest heating capabilities from the resistance wires they will often be made thinner so as to be of higher resistance and thereby they will be more susceptible to failure. Additionally, so that one may have the relay return to inactive or initial position one will often have to incorporate special cooling means so that the gas pressure will be reduced and the liquid contact metal will be returned to its initial location.

By means of the present invention, various problems associated with conventional relays and liquid contact switches may be avoided or overcome. For example, trouble-free relay operation may be achieved without using conventional electrical coils, windings, magnetic fields, and solid contacts, which are prone to wear and corrosion. Relays of this invention may be made in various sizes and are suitable for high power switching operations as well as for use in miniaturized circuitry and in conjunction with printed circuit boards. They operate satisfactorily over a wide range of temperatures and do not require excessive heating of resistance elements or gas. Usually they do not even have to be heated more than a few degrees, e.g., 10° C., to work effectively. They are promptly responsive to the flow of primary current, mainly because of the very high surface areas of the motor elements thereof and the intimate contact of the electrically conductive (yet of sufficient electrical resistivity) network fibers or struts thereof with expandable fluid, e.g., gas in the multiplicity of cells or openings within the network of the motor. Also, by use of the improvements described herein rapid return to initial gas pressure is obtainable so that the relay is quickly ready to be operated again.

In accordance with the present invention there is provided a liquid contact relay which comprises a body of solid material containing gas in a multiplicity of intercommunicating volumes therein, which body is of a sufficient resistance to the flow of electricity so that as electricity is passed through it the material thereof is heated and readily transfers heat to the gas contained therein so as to heat and expand such gas, an electrically conductive liquid which alternately completes and opens a relay circuit in different positions of such liquid, and means for operatively connecting the expandable gas of the body with the conductive liquid so that when electricity is passed through the material the gas therein is expanded and such expansion causes movement of the liquid to change the relay circuit to open or closed state from its previous condition.

In a preferred form of the invention the body portion of what might be characterized as the motor element is of reticulated vitreous carbon, the gas therein is helium and the conductive liquid is mercury. In other preferred aspects of the invention a thermally conductive reticular body of sintered metal is additionally present in communication with the expanded gas and helps to absorb heat from it and to conduct heat away, thereby promoting return movement of the conductive liquid upon discontinuance of flow of electricity to the "primary". Such cooling effect is further aided by fins in contact with the thermally conductive material. Apart from the relay or switch embodiments of this invention it is considered that the motor component thereof, in itself, is significant. In accordance with this aspect of the invention, a motor, useful for activating a liquid contact relay or other suitable article or component to be moved or activated by pressure, comprises a body of electrically conductive solid material containing gas in a multiplicity of intercommunicating volumes therein, which body is of sufficient resistance to the flow of electricity so that as electricity is passed through it the material thereof is heated and readily transfers heat to the gas contained therein so as to heat and expand such gas, and means for transmitting pressure developed by the expansion of such gas so that such pressure may effect movement of a relay component or other means in response to the flow of electricity through the body of solid material and to the gas pressure thereby produced.

Such motors may also be independently equipped with cooling means, as previously described for liquid contact relays incorporating them. Also within the invention are methods of operating the described motors and relays; the use of a volatilizable liquid in conjunction with the vitreous carbon or other suitable heat and pressure generating body to create pressure due to a change of state of the liquid, when heated; the use of a porous metal as a coolant for the present motors; and the employment of metal plated porous ceramic solids in replacement of vitreous carbon therein.

The invention will be readily understood from the description thereof in this specification, taken in conjunction with the drawing in which.

Figure 1:
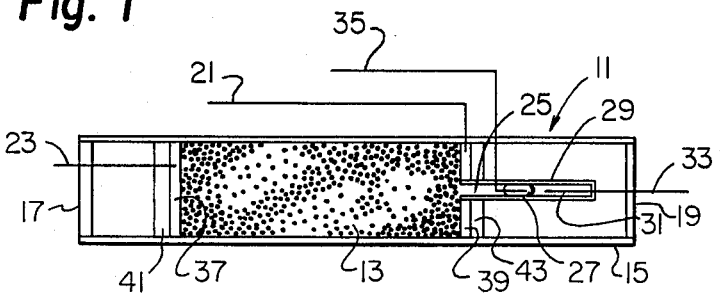
FIG. 1 is a partially schematic central longitudinal vertical sectional view of a liquid contact relay of this invention in open position, with the conductive liquid metal switching element shown not completing electrical contact between leads in the secondary circuit.

In FIG. 1 liquid contact relay 11 is of the type first reduced to practice by the present inventor, wherein a body 13 of a porous material, preferably reticulated vitreous carbon, is enclosed in housing 15, in this embodiment a tube of glass, sealed off at ends 17 and 19 with a synthetic organic polymeric material seal, in this instance such ends being made of Teflon ®. The reticular material is heated by application of an electric current through leads 21 and 23 to heat a gas contained therein and to increase the gas pressure in passageway 25, which is hermetically sealed to the walled chamber in which the reticular material is present. The gas pressure resulting then moves a slug, drop or other shape of a body 27 of mercury in tube 29 so that it will contact end portion 31 of lead 33 and complete an electrical circuit between that lead and mercury-contacting lead 35, both of which leads are connected to a source of electricity and a "load", not illustrated. The heat generating reticular material and the housing for it are preferably cylindrical and are shown to be of such shape but may also be of other shapes, e.g., rectangular prisms, cubes, strips and slabs. Also, while other porous materials may be used for the motor, reticular vitreous carbon is preferred. Hence this description will be with respect to such preferred parts. The cylinder 13 of reticulated vitreous carbon makes electrical contact at both ends thereof with conductive metallic caps 37 and 39. Leads 21 and 23 are shown connected to such caps and on closing of a suitable switch or when activated by other such means, not shown, supply electricity from a suitable source, not shown, to the reticulated vitreous carbon (so-called primary electricity), which heats the carbon and causes it to generate a pressure due to the expansion of gas in the many interconnecting small "cells" or openings thereof. Reticulated vitreous carbon cylinder 13 is held in place in the glass cylinder by cement covers 41 and 43, which also help to position leads 21 and 23, caps 37 and 39 and tube 29, containing passage 25. As illustrated, no clearances are present between carbon cylinder 13 and tube 15 and the pressure developed by heating of the cylinder is transmitted from body 13 directly to tube 29 to move mercury slug 27. However, in other applications (and even in this device) other surfaces of the reticulated vitreous carbon may be available for release of gas pressure generated by heating of the carbon and contained gas and such pressure may be transmitted to a slug, droplet or film of mercury to move it into and/or out of electrical contact, when and as desired.

Although liquid contact relay or switch 11 may be used to effect almost instantaneous switch and relay responses in electronic and microelectronic circuits the principle thereof may be applied to heavy duty and high capacity switches and relays too and such switches and relays are within this invention. For example, see FIGS. 10 and 11. Thus, although in the illustrated device of FIG. 1, like that reduced to practice by the invention, the closing of the secondary circuit, which has been studied with the aid of a magnifying lens, actuated an LED in series with a resistor and a nine volt battery, high current-carrying switch and relay applications are also feasible. Also, as was provided for in the first experimental model of the invention, response time of the relay may be regulated, as desired, by appropriate movement of lead 33 and end 31 thereof either toward or away from the mercury droplet or slug in tube 29, so that contact of the moving mercury slug with the lead will be earlier or later in response to pressure.

Figure 2:
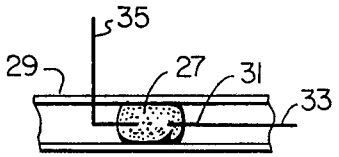
FIG. 2 is a similar view (enlarged) of a part of the device of FIG. 1, with the secondary circuit being shown as completed, due to movement of the mercury in response to pressure generated by the novel motor of this invention.

In FIG. 2 mercury droplet 27 is shown in contact position, connecting lead 35 and end 31 of lead 33 after movement of the droplet in tube 29 in response to pressure generated by the heating of gas in the reticular body, shown in FIG. 1.

Figure 3:
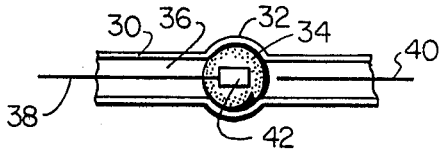
FIG. 3 is a view of the type of FIG. 2 but with respect to different tube and contact structures.

In FIG. 3 tube 30 includes a spherical bulge portion 32 which is adapted to hold mercury drop 34 in place therein and to promote return of the drop to position therein upon release of pressure, by means of surface tension forces. Otherwise the droplet could tend to stay on the right. Thus, as shown, the secondary circuit is open but upon transmission of pressure to passageway section 36 drop 34 will move to the right and will electrically connect conductors 38 and 40 (through end contact member 42 on wire 38).

Figure 4:
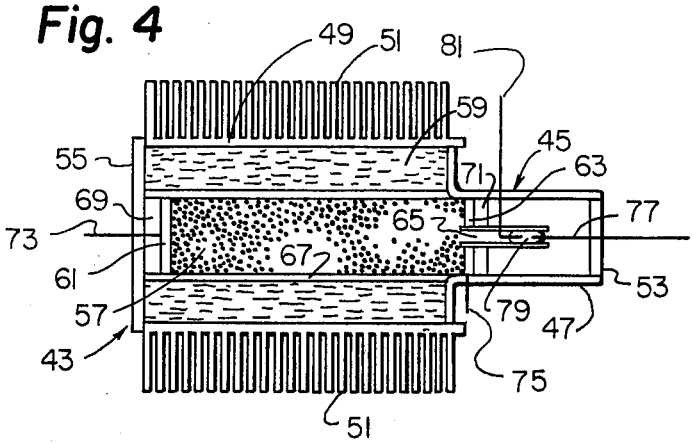
FIG. 4 is a partially schematic central longitudinal vertical sectional view of a modification of the device of FIG. 1, wherein novel cooling means are also present.

FIG. 4 illustrates a liquid contact relay or switch resembling that of FIG. 1 but with additional means having been provided to assist in conducting heat away from the reticular vitreous heating element after cessation of the desired activation thereof. In FIG. 4 liquid contact relay 43 includes an outer metal housing 45 having smaller and larger diameter cylindrical wall sections 47 and 49, respectively, with the larger section having cooling fins 51 thereon. The housing is capped by end members 53 and 55. In the larger end there are contained reticular heating element 57 and surrounding tubular heat transfer or cooling member 59, which is in good thermal contact with heat conducting metal wall 49 and through such wall, with fins 51. Reticular heating element 57, containing very fine pores with gas therein, is held in an enclosure defined by walls 61 and 63, the latter of which has a passageway 65 through it, and circumferentially surrounding heat conductive but electrically insulating sleeve 67. Walls 61 and 63 are electrically conductive, in intimate contact with heating element 57 and are held in place by cement or equivalent walls 69 and 71. Electrical leads 73 and 75 conduct electricity to said conductive walls and through the reticular heating means 57, when desired, as in response to the closing of a switch in an electric supply circuit, not illustrated, which includes such leads. As with the device of FIG. 1, in response to heating of the reticulated vitreous carbon or other porous heating element, expansion of gas therein creates a pressure which moves a slug of mercury 79 or equivalent conductive material into contact with secondary electrical lead 77 to complete a circuit through the mercury from lead 81. Upon lowering of the gas pressure the mercury will move back toward the reticular heating element, breaking contact with lead 77 and opening the secondary circuit. Often the designed use of the relay will not require quick return to initial open circuit position of the mercury or other pressure responsive element but when such quick return is desirable the illustrated porous metal sleeve 59 is capable of absorbing heat and helping to lower the pressure after flow of heating electricity to the reticulated heating element is halted. It is found that the use of reticulated or sintered metals of high surface area:volume ratios is unexpectedly advantageous in promoting quick cooling and acting as a heat sink to diminish the initial pressure surge due to the flow of electricity through the reticulated vitreous carbon or similar material.

Figure 5:
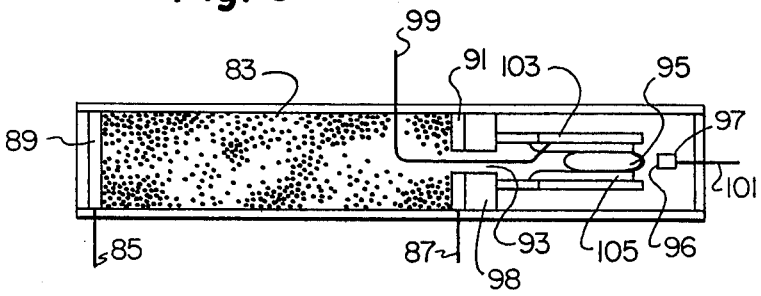
FIG. 5 is a partially schematic central longitudinal vertical sectional view of another liquid contact relay of this invention, wherein a metal or magnetic slug, wetted with mercury, is substituted for the mercury as a moving relay element.

In FIG. 5 reticular heating means 82 are shown, heated by electricity passing through leads 85 and 87 and metallic end caps 89 and 91. Pressure developed by heating the reticular motor element 83 is transmitted via passageway 92 and moves a mercury-wettable metal slug 95 toward a contact surface 96, also mercury wettable, of conductor 97. As shown, the circuit is in open position but when slug 95, in response to generated pressure, contacts terminal 97, electricity will be able to flow through the secondary circuit through leads 99 and 101. Note that lead 99 communicates with metallic tube 103 which conducts electricity to slug 95 through mercury film 105. In the embodiment of the invention illustrated, the moving element is not a conductive liquid but it is wetted by mercury on its switching or contacting surface and the other contact is also so wetted. Additionally, mercury in tube 103 acts as a pressure seal and as a "bearing lubricant" to allow movement of the slug in response to generated pressure. The slug may be of a magnetic material so that it will return to starting position due to magnetic attraction after heating is stopped. for example, wall 98 may be made of nickel-cobalt magnetic material or could have such embedded therein.

Figure 6:
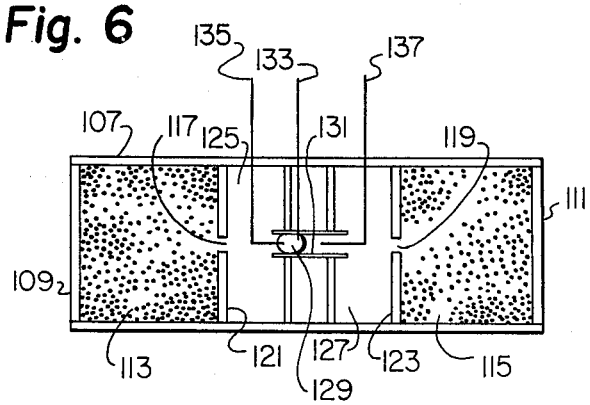
FIG. 6 is a partially schematic central longitudinal vertical sectional view of a two motor momentary latching relay of this invention.

FIG. 6 shows a double-acting or double-throw switch, similar in action to a mechanical single-pole, double-throw switch but more rapidly responsive. In this figure, casing 107, cylindrical in shape, with end closures 109 and 111, has in it two reticular heating units 113 and 115. Means for conducting electricity to the heating units are not illustrated but may be of types like those previously described. The pressure of expansion due to heating will be conducted through openings 117 and 119 in separating walls 121 and 123, respectively, to chambers 125 and 127, respectively. Mercury droplet 129, in tube 131, held between chambers 125 and 127, may move either to the left, as shown, or to the right, making selective contact with common lead 133 of either lead 135 or lead 137 to complete the electrical circuits, not shown. In such embodiment of the invention, by energizing either heating motor part 113 or 115, selective switching operations are obtainable. In another operation of this embodiment of the invention, when it is desired to return the mercury to initial contacting position after it has been moved into the other contacting position, the other motor may be energized to promote such return. In some such cases one of leads 135 and 137 may be omitted so that a single circuit will either be opened or closed but the two motors may still be employed. Also, by changing the size of the mercury drop and/or relocating the leads one may move the mercury to a neutral position, wherein it leaves both circuits open, or may selectively activate the circuits by operating the respective motors. By designing leads 135 and 137 so that they have enlarged ends thereof for contacting the mercury droplet one may take advantage of the surface tension between the mercury and said lead ends and the latching effect caused by it to obtain a momentary latching relay wherein the selective application of heat and resulting pressure can cause movement of the mercury and breaking of the "latch" which otherwise holds the electrical contacts together.

Figure 7:
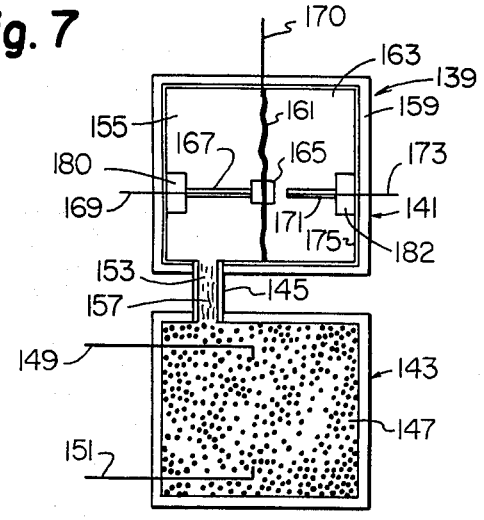
FIG. 7 is a partially schematic central longitudinal vertical sectional view of a diaphragm-type relay of this invention.

A thermal impulse relay of the liquid contact and diaphragm type, capable of developing strong forces and operating heavy duty electrical switches, is shown in FIG. 7. In such figure numeral 139 designates the complete unit, 141 is for the diaphragm switching portion, 143 represents the heat generating motor unit and 145 is for the connecting means between them. Motor unit 143, as illustrated, contains only the electrically heatable porous material 147, which is heated by application of electricity across leads 149 and 151, generating pressure, which is transmitted through passageway 153 in connector 145 into the interior of chamber 155 in diaphragm unit 141. Passage 153 is filled with glass wool 157 or similar other non-wetting (to mercury) packing material through which pressure may be transmitted, for reasons which will be apparent later. Diaphragm switch unit 141 includes a wall 159 about it and a thin diaphragm 161 connecting, as illustrated, the top and bottom of said wall and dividing it into chambers 155 and 163. In the middle of the diaphragm is an electrical contact 165, connected by conductor 167, with which it is shown to be in contact, to a lead wire 169. Another conductor 171, in chamber 163, communicates with electrical lead 173. As illustrated, conductor 167 is in electrical communication with contact 165 so a circuit connecting leads 169 and 170 is in closed position.

Upon heating of the motor unit by passage of electricity through a circuit including leads 149 and 151 and reticulated vitreous carbon or similarly useful material 147, the gas in the matrix expands to generate a pressure which moves diaphragm 161 and contact 165 thereof into contact with conductor 171 so as to complete a circuit between leads 173 and 170 and at the same time, break the contact with conductor 167 and open the circuit between lead 169 and lead 170. Upon halting of the application of electrical power to motor unit 143 the pressure in chamber 155 will diminish and corrugated diaphragm 161 will return to initial position, causing contact 165 to be in electrical contact with conductor 167. Thus, the diaphragm switch unit completes one of two circuits, depending on whether or not the pressure in one of the diaphragm switch chambers is increased due to electrical heating of the motor material in the motor chamber. Of course, a similar action will occur when the motor element is heated, whether by electrical or other means, e.g., microwave radiation, sound waves, infrared radiation, conductivity, etc. but direct electrical heating of the motor material, as described, is highly preferred.

In FIG. 7 there is shown along the walls of the interior of the diaphragm switch unit a coating or film of mercury 175. Such coating is on the walls, the electrical contacts and the diaphragm. It does not cover the glass wool 157 or other material separating the motor and diaphragm switch units and does not cover electrical conductors 167 and 171, being held away from them by non-wetting mounts 180 and 182, to avoid short-circuiting. However, the contacts made are contacts with a liquid metal, which makes the contact surfaces renewable and long lasting due to constant replenishment of such liquid metal at the contact points.

In the present illustration the motor and switch units are shown as separable units connected together in use. Such construction facilitates changing to motors of different capacities and to diaphragm switches of different tensions and current carrying capabilities, as may be desirable.

Figure 8:
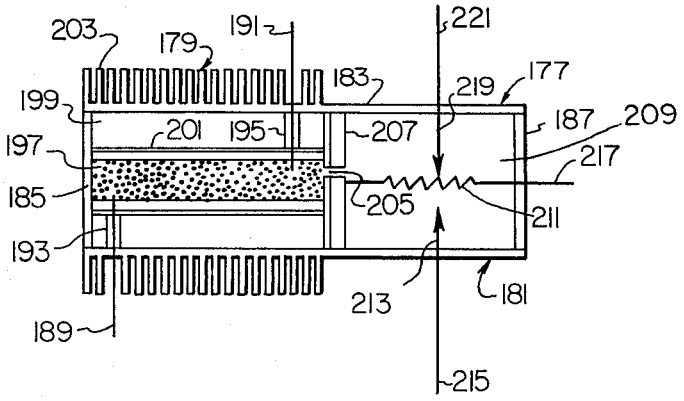
FIG. 8 is a similar view of another diaphragm-type relay of this invention.

In FIG. 8 there is shown a diaphragm switch resembling that of FIG. 7, with the main difference being in a unitary body structure being employed and in the provision of cooling means in such body for promoting rapid return to initial position of the diaphragm after movement thereof in response to pressure generation by the heat generating motor. Diaphragm switch 177 includes both heat generating motor portion 179 and diaphragm switch portion 181 in a cylindrical metal tube 183 with insulating end plate 185 and either insulating or conductive end plate 187 closing the tube. Leads 189 and 191 carry electricity through insulated passageways 193 and 195, respectively, to porous heating element 197. Element 197 is kept electrically insulated from surrounding porous conductor 199 by insulating cover 201, which allows heat and gas transfer to the conductive porous metal body 199, and through it and wall 183 to cooling fins 203 so as to speed the lowering of pressure after halting of flow of electricity through the heat generator. Upon heating of motor element 197 pressure is transmitted through passage 205 in wall 207 into chamber 209 and causes movement of flexible diaphragm 211 so that it makes contact with conductor 213, thereby completing a circuit between lines 215 and 217. Upon halting of current flow through the heat generator 197 the pressure is diminished and diaphragm element 211 returns to contact with conductor 219, thereby again completing the circuit connecting leads 217 and 221, as shown. The contacts of the switch illustrated are not mercury or of other conductive liquid but they can be converted to such by making changes like those shown in FIG. 7.

Figure 9:
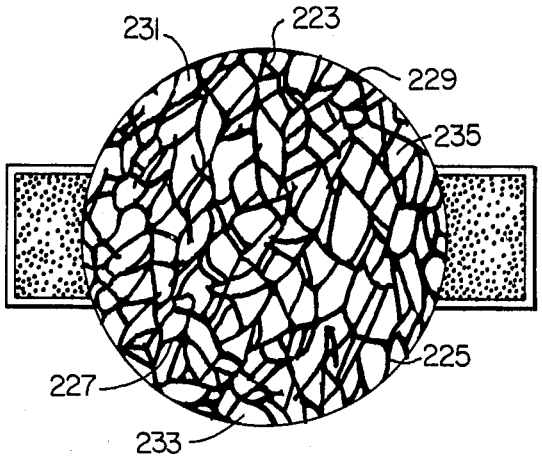
FIG. 9 is a partially enlarged elevational view of a cylindrical motor element of this invention wherein the circled portion is greatly magnified, illustrating the open-pore structure of reticulated vitreous carbon, preferably utilized in the practice of this invention.

In the FIG. 9 microphotographed portion of a specimen of reticulated vitreous carbon of the type employed in the heat generating motors of this invention, various elements of the reticulum, that is, the solid struts of the open cell "walls", are illustrated, as at numerals 223, 225, 227 and 229, and cells or pores are shown, as at 231, 233 and 235. The rod-like struts form a network of openings which are interconnected as open pores or cells so that gas pressure developd in the interior of the body of such material may be transmitted outwardly. Also, as will be seen from the microphotograph, because of the relatively thin struts, which are of electrically conductive material which is yet of sufficient electrical resistivity, heat may be generated throughout such body and may heat the gas contained therein to develop the pressure required for the operation of the present invention. The porous metal cooling means previously described herein may also be of structure like that shown in FIG. 9.

Figure 10:
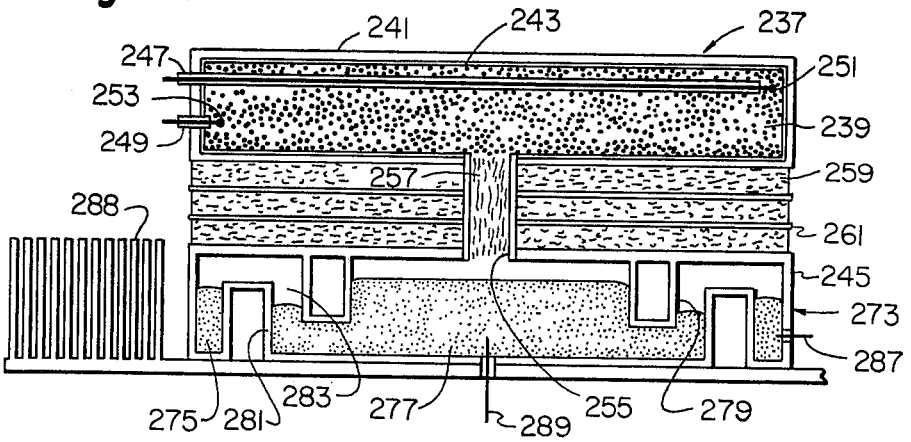
FIG. 10 is a somewhat schematic partial central vertical sectional view of a high current, high power liquid contact relay, which may be circular in plan view, shown in open relay switch position.
Figure 11:
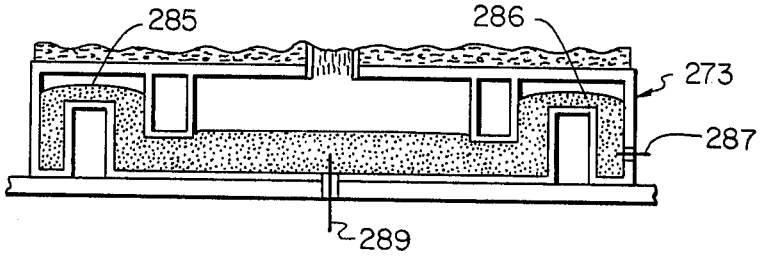
FIG. 11 is a part of the relay of FIG. 10, in closed relay switch position.

In FIGS. 10 and 11 there is shown a high current, high power, liquid contact relay 237 in which a contact is made or broken between two mercury pools. Referring to FIG. 10, wherein such switch is in open or non-contacting position, the essentially flat cylindrical switch 237 includes reticular motor 239 in a casing 241, in which it is held in place by a silver epoxy cement 243. Such cement is not sufficiently conductive or continuous to short circuit the motor 239 and the casing 241 is preferably of non-conductive (electrically) material, e.g., glass, plastic (nylon, etc.) but may desirably be thermally conductive. Electrical inlet leads to the reticular motor material are shown at 247 and 249, with the former being insulated and extending through the motor to an ininsulated end 251 and with the latter having an uninsulated end 253 at the opposite end of the motor material. Thus, when an electrical current is allowed to flow between ends 251 and 253 the reticular motor 239 is heated and the gas (hydrogen) contained therein is expanded. The expanded gas flows through a passageway 255 between the upper and lower sections of the switch, which passageway is packed with a glass wool plug 257. For desired control of temperature of the gas developed by operation of the motor, between the upper and lower sections of the switch there are present a plurality of thicknesses 259 of microballoon quartz insulating material, preferably Emerson and Cuming, Inc. FT 202, which has a low thermal conductivity, close to that of air, and which is opaque to infrared rays. The layers of the microballoons are separated by aluminum or other thermally conductive metal plates 261 for control of the cooling rate.

Lower switching section 273 includes lower wall 245 which is desirably of a highly heat conductive material, such as silver or copper, but aluminum and other suitable heat conductive materials may also be employed. Such section also has a mercury outer ring portion or pool 275 and a mercury inner ring portion or pool 277. Between such rings are dividers 279 and 281 which form weirs or dams to maintain the mercury sections out of contact with one another until pressure is applied to the top of the inner mercury pool by generation of gas due to heating of the reticular motor. When that happens, as is shown in FIG. 11, the mercury in the central portion of the switch descends or moves to the outside thereof and thereby forces mercury up the connecting passageway 283 so that, as shown in FIG. 11, at 285, the mercury bridges the inner and outer sections and conducts electricity between leads 287 and 289 through the mercury at 286. From this description it is seen that by regulating the sizes of the dams, weirs and passages a slight motion downward of the mercury in the central pool can cause a significant upward movement of the peripheral mercury, resulting in almost instantaneously responsive, good conductive electrical contact in the relay "secondary". Radiating fins 288 are shown, which function to cool off the expanded gas and thus return the motor to initial position (non-contact) when current flow to the motor is cut off. Also, the microballoons 259 are excellent insulators but the aluminum plates 261 also allow for dissipation of any heat generated to aid in reactivation of the relay subsequent to termination of the passage of electricity through the motor.

It is highly desirable that the hydrogen gas temperature in the lower chamber, particularly in the outer ring thereof, be kept lower than that in the recticular motor and to help accomplish this the walls of the lower chamber will be of a high thermal conductivity material as previously mentioned. The separators or dam walls, such as those at 281, will preferably be of a high thermal conductivity material which is still an electrical insulator. Beryllium oxide ceramics, which are of high thermal conductivity and yet are electrical insulators, are excellent materials of construction for such parts and act to suppress any electric arcing which might otherwise occur.

As will be seen from the previous description, the most important component of the present relays and pressure-generating motors is the main motor portion thereof, which generates a pressure on application of an electrical current to it. Such motor element comprises a body of solid, normally form-retaining material which contains a gas or a mixture of gases in a multiplicity of intercommunicating volumes thereof. Such body, which is normally light in weight, is very preferably of a much higher gas volume than solids volume, is in reticulated or open cell form and is of a sufficient resistance to the flow of electricity so that as electricity is passed through it the solid material thereof is heated and readily transfers heat to the gas contained therein so as to heat and expand such gas and generate a pressure. Of the various materials that are suitable or may be made suitable for application in the present apparatuses and processes, reticulated vitreous carbon is highly preferred. It is presently available from Chemotronics International, Inc. and is sold under the trademark RVC. Such material has been described in a 1976 publication of that company entitled *Reticulated Vitreous Carbon* (*An Exciting New Material*). In such bulletin and in application notes 7041 and 7051, issued by the same manufacturer, the characteristics of the material are described, as are fabrication and bonding techniques and fabrications of various shapes, including cylinders, slabs, rectangular prisms, tubes and helices. Additionally, such materials and methods for their manufacture are described in various U.S. Patents, including U.S. Pat. Nos. 3,927,186; 4,017,570; 4,017,571; 4,022,875; and 4,067,956.

The motor elements of this invention will usually have a void volume of about 40 to 99% of the total bulk volume thereof, will be of a porous structure containing from 10 to 100,000 pores per cubic centimeter and will be of a density in the range of 0.01 to 0.5 g./cc. Preferably they will be of a void volume in the range of about 90 to 99%, of a porous structure containing 400 to 64,000 pores/cc. and of a density of 0.03 to 0.1 g./cc. and more preferably the void volume will be 95 to 98%, the porosity will be 5,000 to 64,000 pores/cc. and the density will be 0.03 to 0.06 g./cc. In the computation of the number of pores or cells in the body of the reticulated vitreous carbon the number of cells per unit length, shown by microphotograph, has been cubed. The area per unit volume is usually at least 100, preferably 100 to 10,000 or 200 to 5,000 and most preferably from 500 to 2,000. Of course, in computing such area:-volume ratios the units of length utilized are the same.

The cells of the motor element may interconnect via passageways smaller than the sizes given above or equal thereto, depending on the method of manufacture but the important thing with respect to the present invention is that such cell walls provide a path for the flow of electricity through which it may pass from one end or near one end of a body of such material to the other end or near the other such end and because of the resistance of such conductive body, heat will be generated therein which will be transmitted to the gas in intimate contact with the conductive (yet resistive) cell network. The heating of such gas causes an expansion thereof and a development of pressure sufficient to actuate whatever device is being employed in conjunction with such motor. The resistance of the motor body will usually be in the range of 0.1 to 4 ohms/cm. of length, for example, 0.3 to 2 ohms/cm., but such resistances can be varied for particular situations, as by deposition of more conductive or less conductive coatings on the surfaces of the cells. A typical useful motor material, often employed in cylindrical form and supplied by Chemotronics International, Inc. under the trademark RVC, has a bulk void volume of 97%, a bulk density of 0.05 g./cc., a strut density (that of the carbon itself) of 1.5 g./cc., a strut resistivity of 0.005 ohm/cm., a crush strength at 21° C. of 0.7 to 3.5 kg./sq. cm., excellent thermal shock resistance, no objectionable shrinkage, no volatiles and a sublimation point of 3,500° C. Because of the excellent porosity of the material pressure drops from gas flow through it are very low. For example, pressure drops which are less than 0.1 mm. of mercury/cm. are sometimes found for such reticulated vitreous carbon motor bodies when the gas (air) velocity through them is as high as 120 meters per minute. Such pressure drops are normally in the range of 0.1 to 8 mm. of mercury/cm. for air velocities from about 60 to about 250 meters per minute. Thus, it is seen that expansion of gases contained in the cells of the motor meets with little resistance and may be almost instantaneous.

In addition to the RVC™ type material available, also useful are other products from the mentioned manufacturer identified as RVC-4, RVC-A, and RVC-N, although the RVC, RVC-A and RVC-A2 types are preferred. The elements of the network (struts) have high gas-contact surface areas. The total surface contacted by the gas is greater than the geometric surface area of the network. RVC-A has a surface area of 500 sq. meters per gram and RVC-A2 has such an area of 4,500 sq. m./g. All such products are resistant to deterioration upon the application of heat and so are ideally suitable for use in the present invention, wherein heating is employed. Even in the presence of air in the finely divided cells of the reticulated vitreous carbon motors no deterioration upon heating is obtained until the temperature exceeds 315° C. and such deterioration is only noted because of the presence of oxygen, air or other oxidizing gas. Thus, when, as will be discussed further, hydrogen, argon, helium, nitrogen or other non-oxidizing gas is present in the motor body instead of an oxidizing gas, the temperature may be raised much higher without any deterioration resulting.

In addition to reticulated vitreous carbon, various other structural materials may be employed which have the desired cellular structure and are capable of generating heat and expanding contained gas therein upon such heating. For example, U.S. Pat. No. 3,629,774 describes a resistance element of elastic material. Also, as was previously alluded to, conductivities of broken bubble or open-celled foam materials may be varied by deposition therein of conductive or resistive materials. While it is highly preferred that the motor body be unitary and form-retaining, not readily distortable by application of pressure or force thereto, it is within the invention to utilize motor elements made up of a plurality of pieces of reticulated vitreous carbon, in coarse particle or even in powdered form in a suitable container, as it is within the invention to shape such materials as desired. For example, one may increase the resistance of the motor by utilizing a helical shape, with the electric heating circuit being completed at both ends of the helix (preferably with gas porous insulating material packed between). In such application the insulating material may be present to prevent short-circuiting, if the chance of that occurring is considered to be substantial. Although firm motor bodies are preferred it is possible to substitute elastic or flexible cellular foams, made satisfactorily conductive (and resistant) so as to have resistivities like those previously mentioned, by application of conductive coatings, such as powdered metals or resistor coatings, such as alumina, on the cell network, often in conjunction with each other. Such flexible foams may also be unitary or composed of a plurality of parts pressed together into electrical contact. While it is highly preferred that the reticulated materials be of open-celled construction, when the product itself will expand sufficiently to generate the desired pressure or force in response to the flow of "primary" electricity through it, closed-cell foams or mixed closed- and open-celled foam flexible products may be utilized.

In addition to the highly preferred reticulated vitreous carbon, which is often manufactured by the carbonizing of a polyurethane foam, as described in the patents previously cited, among other preferable motor units are those made by electrodeposition, either electroless or electrolytic deposition, onto a non-conductive foam, such as one of alumina, silica, magnesium oxide or zirconium oxide, of a conductive metal, such as palladium, platinum, silver, nickel, chromium, aluminum or copper or suitable conductive oxides thereof. In one such application, silica or other insulating powder is deposited in sub-micron form on a polyurethane or other suitable organic foam, the oxidizable material is removed by heating in the presence of air and the refractory framework remaining is immersed in a palladium nitrate solution, after which the impregnated framework is heated and the palladium nitrate is calcined to palladium oxide, which may then be reduced by hydrogen to palladium, if desired. Instead of following such method, a mixture of sub-micron silica and palladium oxide particles may be electrophoretically coated onto a sponge which may then be oxidized to leave only the palladium oxide-silica mix and the palladium oxide may be reduced to the desired extent to obtain the desired conductivity-resistivity properties for the motor. Similar control of conductivity and resistance may be obtained by utilizing other metal salts than those of palladium, including those of metals previously mentioned in this paragraph. Alternatively, porous glass or other materials may be utilized and in some cases the motor bodies may be formed from microballoons of glass or other suitable material, which may be held together by deposits of metals or conductive metal oxides at contact points.

Normally the gas in the porous motor body will be air, as such material is supplied, but other gases may often be more advantageous. Thus, when the air is displaced by hydrogen or helium (and preferably the whole motor system will have such gas throughout, rather than different gases in different portions thereof) or a mixture thereof, despite the higher (relative to air) specific heats of such gases, expansion in response to electrical heating will be satisfactory, aided by higher thermal conductivities. When comparatively inert or reducing gases, such as hydrogen, helium, argon, nitrogen and carbon dioxide, are utilized, heating to higher temperatures may be employed without possible adverse oxidation of the "network" material. Because of the interconnected cells of the most desirable motor material it is a simple matter to displace the gas therein, as desired, with another gas passed through the porous body and such can often be accomplished in a matter of seconds or minutes.

The connection of electrical leads to the motor may be by any suitable means whereby electricity, either a.c. or d.c., at a suitable voltage, is passed through the body and the current flowing is sufficient to heat the motor to expand the gas therein and generate a pressure sufficient to actuate an electric switch or relay or to cause other desired movement. Preferably, the ends of the motor are each covered with a conductor, such as conductive metal, e.g., silver, copper or aluminum, which may be held to the porous body by a conductive cement, e.g., silver epoxy cement or gold epoxy cement, wherein silver or gold metal flakes are present in the epoxy matrix, or by any other suitable conductive adhesive or fastening means. Activation of the heating circuit may be by means of a switch or other means responsive to a particular condition intended to cause activation of the relay or "secondary" switch, e.g., a heat sensor.

The motor body element of the present invention, with means for applying electric voltage across it, is preferably encased in a gas-tight container, shell or cover, such as one of glass, metal, alloy or synthetic organic polymeric material. However, it is within the invention merely to have the pressure generated by the heating of the body portion communicated to pressure-responsive means and such can be done by affixing a means for transmitting pressure from the motor to such responsive item. Such means may be fluidic, mechanical or of other suitable nature. In some cases it may not even be necessary to attempt to confine the expanded gas within the motor body except for that portion allowed to move to transmit the desired pressure. Thus, the reticulated vitreous carbon can be used as supplied, with means connected to the interior thereof for transmitting pressure developed, while it is still allowed for such pressure to be dissipated quickly by escape of gas through the motor body. However, usually it is much preferred that the pressure be confined, except for the desired outlet to means to be activated by it, and therefore the motor will normally be covered or coated on most of the surface thereof to prevent release of pressure (except where desired) or will be enclosed within a gas-tight shroud or container, which may be tight fitting against the motor body or relatively loosely enclosing it.

The sizes of the motor body elements may vary over wide ranges, usually depending on the force or pressure that is needed to actuate a switch or other responsive device. Thus, such volume may be as low as 0.1 cc. or as much as a cubic meter but normally will be within the range of 1 to 100 cc., preferably being from 1 to 10 cc. The voltage applied, whether a.c. or d.c., will usually be in the range of 0.1 to 220 volts but normally will not be greater than 120 volts and preferably will be from 1 to 20 volts, more preferably from 1.5 to 12 volts. The current flow will normally be from 0.01 to 10 amperes, preferably being 0.05 to 1 ampere and more preferably 0.1 to 0.3 ampere. The temperature to which the motor is heated will usually be from about 1° greater than room temperature to 300° C., preferably being from 25° C. to 80° C., most preferably from 30° C. to 50° C.

In many instances the present pressure generating motor will merely have to operate a relay momentarily in response to the application of electricity across the motor body. Thus, means will be provided to discontinue the flow of electricity to such body after a short period of time to prevent continued heating thereof and the relay will otherwise be held in either open or closed position, as desired. Under such conditions, the heated motor body may soon lose its heat content and be ready for subsequent application of electricity to re-generate an actuating pressure. However, in those instances wherein cooling of the motor body is not quick enough for designed applications it may be desirable to have a heat conductive container for the motor body, which will be electrically insulated from it so as to prevent short-circuiting during the heating operation and which will be effective to discharge thermal energy to the surroundings, thereby speeding the cooling of heated gas, the diminution of pressure developed and return to starting position of the relay, switch or other means to be activated. It has been found that the discharge of heat from the motor, after actuation of the relay, etc., may be speeded by having located near the motor element a foam or porous body of metal or other conductive material, which acts as a heat sink and absorbs the heat and pressure generated by the motor body shortly after development thereof. Thus, the motor may activate a relay but shortly after such activation (after interruption of the supply of heating power to the motor) the porous metal will absorb heat and pressure developed and help to speed return of the motor to initial condition.

The porous metal that may be utilized may be such as is known as foamed metal, some types of which are available from Foametal, Inc., Dunlop Limited, Hydro-Jet Corp. and others. Such products are described in the publication *Iron Age,* in the Aug. 23, 1976 issue. They are available in various low densities and in various metals, including nickel and copper, but similar materials made from aluminum, iron, stainless steel, silver and other conductive metals may also be used. Such foamed metals may be made in various ways, by sintering, electrodeposition of metallic salts on synthetic organic polymeric foams, followed by pyrolysis and reduction, or by other suitable means. For simplicity's sake they will be referred to herein as sintered metals or metal foams. They will generally have a void volume of about 40 to 99% of the total bulk volume thereof, will be of open-cell structure containing from 10 to 100,000 cells /cc. and will be of a density in the range of 0.2 to 2 g./cc. In fact, their porosity characteristics, as described, and in preferred and more preferred embodiments, are like those of the motor body material but because of the greater density of the metal components, densities of the sintered metals are generally higher, preferably being in the range of 0.4 to 1 g./cc. Their area:volume ratios are also about the same as those for the motor element.

In the preferred cylindrical form of the motor body of this invention the sintered metal will preferably be in the shape of a collar or a surrounding cylindrical tube with respect to the motor body and the interior of such tube will be as close as possible to the exterior of the motor body. However, other forms of the heat absorbing material may also be employed, depending on the motor body shape. For flat motor shapes the heat absorbers may sandwich the motor element, for motor cubes they may cover the six sides and they may surround spherical motor bodies, as with a skin. The volume of the heat absorber will normally be from 0.1 to 100 times that of the motor body, preferably being from 0.2 to 5 times and most preferably about 0.5 to 1.5 times such volume. The gas inside the sintered heat conductive material may be any of those previously described and preferably will be one having a higher heat capacity so as to be effective as a heat sink. Thus, hydrogen may often be preferred to air, $CO_2$, nitrogen, argon and helium although in some instances, so as to maintain the presence of only one type of gas or gas mixture in the motor unit assembly, the gas in the sintered metal portion may be the same as that in the motor body.

Whether or not a sintered metal or other porous metal heat sink is employed the pressure generating portion of the present article will preferably be in a closed volume container with the only opening being to the unit to which the pressure is to be applied for actuation of the secondary of the relay, etc. Although such container may be glass, as previously indicated, in many instances it is preferred that it be of a metal of high thermal conductivity so that heat and pressure generated may be quickly dissipated and the article may be reactivated for use in response to further applications of primary electricity. In such an instance a metal casing is desirable and preferably it will be in close, although insulated, contact with the motor body, if no sintered metal heat sink is interposed, or will be in close uninsulated contact with such sintered metal, when employed (with the sintered, expanded or otherwise "porous" metal being insulated from the motor to prevent short-circuiting thereof). If insulation is present it will preferably be a thin porous material which satisfactorily electrically insulates the heated element from surrounding or adjacent conductors so as to prevent short-circuiting but which also allows heat to pass through it, as through voids or openings in it, so as to speed cooling of the motor body. Such insulation may also be employed to separate the heater body from the sintered metal heat absorber, when present. Among the suitable materials which may be utilized are fiberglass, synthetic organic polymeric screening, porous paper sheets and perforated insulators of other types. Normally the thickness of such insulation will be from 0.1 to 5 mm., preferably being from 0.2 to 2 mm.

The conductive case, preferably of copper, stainless steel, steel, aluminum, brass, nickel plated brass, silver, chromium plated brass or other suitable metal or alloy, will preferably have additional heat transmitting means on the external surface thereof, such as heating fins, filaments, wrappings, screens or other structures, the function of which is to conduct heat away from such surface. Such heat transmission means are known in the art and need not be discussed further here.

Although the present invention was initially primarily intended for operation of a liquid contact relay, it has many other uses. However, first its employment in relay functions will be described. Liquid contact relays, wherein a droplet of mercury is moved in response to differential pressure on it, have been illustrated in the drawings. Although preferably the mercury will be in the form of a droplet in a tube, it may also be of such other shape as a confining vessel or passageway dictates. Sometimes it may be in film form, wetting a mercury-wettable surface. Instead of mercury, other known conductive liquids may be utilized in suitable applications, such as conductive salt solutions and colloidal metallic suspensions. As was shown in the description, the liquid contacts may still be made although the moving part is a solid. While a single-pole single-throw type of secondary switch operation of the relay has been illustrated and discussed for simplicity, various other types of relays may similarly be actuated. The generation of pressure by the present unit may activate plural relays or may be employed to connect or disconnect dual legs of a circuit. Also, both contact surfaces may be mercury wetted.

Various types of relays and switches operable by means of the present invention are described in the article "The Relay Race", appearing in the October, 1977 issue of *Electronic Products Magazine.* Current carrying capacities for such products are virtually unlimited, depending only on the designs of the secondary contacts, and in the case of the mercury or other conductive liquid contacts, due to conductive surfaces renewals each making and breaking of contact, such contacts last for millions of operations. Normally, secondary circuit voltages will be in the range of 3 to 500, preferably being 10 to 250 and more often from 12 to 120. Current carrying capacities may be from 0.01 to 100 amperes, but usually will be from 0.5 to 10 amperes and preferably will be in the range of 1 to 5 amperes. Instead of liquid contact relays, various pressure-responsive mechanical contacts may also be made in response to pressure generated by the motor of this invention. In replacement of normally gaseous materials in the pores of the motor body, liquids may be present therein which, when heated, will change state, becoming gaseous and thereby quickly increasing their volume and developing substantial pressures. Pressure enhancement by changing a material from liquid to gaseous state is particularly useful in high-power relays. Among such liquids are those known as volatilizable liquids or liquefied gases, many of which are fluorinated or chlorinated, such as the fluorinated lower hydrocarbons of the Freon®, Genetron® or Ucon® types, often employed as diluents or propellants in "aerosol" compositions intended for spray or foam dispensing from "aerosol cans." Among these materials are Freons 11 and 114, although other which are normally liquids at temperatures up to about 60° C., e.g., in the range of 20° to 50° C., may desirably be employed. Various such materials are described at pages 20 and 21 of the text *Pressurized Packaging* (*Aerosols*), by Herzka and Pickthall, published by Academic Press Inc. in 1958. In addition to the normally liquid but readily volatilizable materials described, normally gaseous materials of such organic types may be employed in replacement of the conventional gases previously mentioned. Also, in some instances it is possible to employ waxes in the present porous motor bodies, which, when heated, melt and expand to generate high pressures. The use of such materials in thermostats and swiches is described in articles in the Sept., 1966 issue of *Instruments and Control Systems* at page 134, in *Product Engineering* of July 11, 1960, at page 74 and in the *Canadian Journal of Chemical Engineering* of April, 1969, at page 53.

In addition to the various types of operations of relays and other switches, the motors of this invention, utilizing the gases, volatilizable liquids, expandable materials or liquids, may be applied to moving actuatable means in response to the application of an electrical potential across such motors. In other words, the invention is not limited merely to the operation of switches with these motors but also relates to producing other effects with them, whether such effects be physical movements in response to pressure or temperature or whether they be other physical, chemical or electronic reactions caused by the present production of heat and/or pressure.

The invention will now be illustrated by a description of the manufacture and operation of preferred embodiments thereof.

EXAMPLE

A liquid contact relay of this invention is made like that illustrated in FIGS. 1 and 2, with a glass tube body 10.8 cm. long and about 1.1 cm. in internal diameter. Such unit is capped at both ends with Teflon plugs, through one of which insulated electrical leads are attached to both ends of a cylindrical "rod" of reticulated vitreous carbon (RVC™) obtained from Chemotronics International, Inc. Such carbon "rod" is about 4.8 cm. long and about 1.0 cm. in diameter. Its density is about 0.05 g./cc., its void volume is about 97% and it contains about 8,000 pores/cc. The area/volume ratio thereof is about 1,000. At each end of the RVC cylinder is an aluminum cap held in conductive contact with the cylinder by silver epoxy cement and at the exterior ends of such caps are deposits of insulating cement which hold the reticular motor element in place in the glass tube. Communicating with an end of the motor is a smaller glass tube (inside a larger one) and inside it are a droplet or short cylinder of mercury and two conductor wires, one of which is normally in contact with the mercury and the other of which is normally out of contact with the mercury but contactable thereby upon movement of the mercury. The inner tube is of an internal diameter of about 1.2 mm. and the mercury slug is about 2.4 mm. along. The inner tube is held in an intermediate glass tube which is mounted in a rubber seal which acts to prevent escape of expanded gas or pressure from the motor section of the LCR. A glass wool plug, non-wettable by mercury, may be present in the inner tube to prevent movement of the mercury past a desired limit, in response to excess pressure or vacuum. In the particular unit illustrated a voltage of about 20 volts a.c. is applied across the RVC motor element by closing of a switch for a period of about 0.5 second, after which it is noted that the mercury moves about 0.8 mm. and completes the secondary circuit electrical contact, lighting an LED which is in series with a 9-volt battery and a 100 ohm resistor. By adjustment of the application of electricity to the RVC body by modification of the voltage and time of application it is found that after interruption of the flow of current in the primary circuit the secondary circuit may be actuatable again within a short period time, as little as 50 milliseconds when hydrogen or helium is the gas in the reticulum. Normally, reactivation of the secondary circuit may take place within a period from such 50 milliseconds (and sometimes as low as 10 milliseconds) to about 5 seconds but usually such time will be in the range of 0.1 to 1 second.

In variations of the invention, the gas in such body may be changed from air to hydrogen, helium, argon, nitrogen, carbon dioxide, propane, chlorotrifluoromethane, dichlorodifluoromethane or mixtures thereof, and similar pressure development and actuation of the mercury relay are obtainable. Hydrogen, hydrogen plus argon, or hydrogen plus helium are the preferred gases to be used with mercury contacts. The hydrogen should be at an elevated pressure, preferably from 1.4 atmospheres to about 5 times atmospheric pressure or more. The high-pressure hydrogen reduces arcing at the switch contacts, prevents mercury evaporation, and acts as a reducing agent to keep the mercury surface clean. Also, when the reticulated vitreous carbon is replaced by a porous refractory or ceramic material, such as a porous silica, onto which sufficient palladium has been deposited by a method described previously in this specification so that the motor element is conductive, yet of sufficient resistivity to develop heat upon passage of electricity through it, similar results are obtainable.

When the relays or switches of this example and of the various figures of the drawing are modified so as to have a porous metal tube of foamed metal, e.g., a copper foam, made by Foametal, Inc., or by Dunlop Limited, London, England, surrounding the motor element and in communciation with heat dissipating fins, response times for reactivation of the relays are diminished appreciably, due to quicker dissipation of heat. This is also the case when the gas in the foamed metal is air and that in the RVC is helium.

Similarly, when apparatuses illustrated in FIGS. 4–8 and 10 are made, with mercury or other suitable electrically conductive liquid being employed therein and with the described RVC being utilized, with either helium, hydrogen or air in the pores thereof and either with or without foamed metal and finned cooling means about the unit, satisfactory switch and relay operations result. In the embodiment of FIG. 8, instead of actuating a switch or relay the diaphragm movement may be employed as a mechanical activator for other means, either electrical or mechanical. Such embodiment and the others may also have a liquefied gas or solid wax in the pores of the motor to obtain change of state expansions upon activations.

In other modifications of the invention, in the articles previously described, when instead of utilizing a unitary porous motor element such as that mentioned, the body is in spiral or helical form or is composed of a plurality of pieces held in contact with each other, similar good results are obtainable. In fact, it is even possible to utilize filamentary or screen material made from the body component of the motor part and such operation may in certain circumstances be satisfactory, although it is not as consistent as that from the solid porous body because of the possibility of shape and orientation changes during use.

The liquid contact relay and motor mechanism of this example are also satisfactorily operative when the switching is changed so that the development of gas pressure by heating the reticular motor produces a relay movement discontinuing the flow of electricity in the "secondary" circuit. Similarly, it is operative when the various embodiments thereof illustrated in the drawings are utilized. For example, utilizing the two-motor construction of FIG. 6, together with a tube for holding the mercury droplet, such as that shown in FIG. 3, it is possible to have a neutral position for the mercury contact, in which no electricity is conducted in the secondaries, and two secondary positions so that electricity is conducted alternately in different circuits, as desired. Similarly, the motor units of the various illustrated embodiments may be employed to activate other switching or different mechanical elements.

Instead of the reticulated vitreous carbon motor element other such elements are useful, as previously described. For example, when a sufficiently conductive coating is applied to a normally electrically non-conductive base network, a useful motor is made, e.g., metal or metal oxide on ceramic. Similarly, the porous heat conductive material for dissipating heat from the motor so as to enable rapid "re-setting" thereof may be commercially obtainable materials such as were previously described or may be made by repeatedly saturating a combustible polymeric or other suitable material with a solution of the metal salt, drying the deposited or absorbed solution between re-applications thereof, burning off the polymer and calcining the metal salt to a metal oxide and then reducing the oxide to the metal, e.g., nickel, by suitable reducing means, such as pyridine or hydrogen. Metal plated or conductive metal oxide coated porous ceramics, when substituted for RVC, also function acceptably well, as do metal plated or conductive oxide coated polymers, often in screen form. In such motors it is highly preferable that the electrically conductive materials be evenly or regularly distributed throughout to make the motors more immediately responsive to current passages.

The insulators about the motors may be of materials which are electrically insulating, yet capable of conducting heat, e.g., boron nitride, silicon nitride or beryllium oxide, so that they can help to dissipate generated heat without short circuiting the motor element. Also, the cooling mechanism may include conductive elements in the body of the motor capable of conducting heat to the surroundings. The electrically insulating, yet thermally conductive materials described above as useful for electrical insulation in the present motors may also be employed as thermally conductive materials for the heat absorber. Thus, in addition to silver, copper and other conductive metals, one may employ silicon nitride, boron nitride, beryllium oxide and diamond dust in a suitable binder, such as beryllium oxide hydrate.

In other aspects of the present invention dual acting and latching motors and relays, such as those of FIG. 6, may be made wherein the motors act sequentially to make or break different circuits or to assist each other in movements to open or close a circuit or to apply or withdraw a force. Thus, in such motors and relays there is included a second body of electrically conductive solid material containing gas in a multiplicity of intercommunicating volumes therein and that body is so located that upon passage of electricity through it the gas pressure developed tends to move a relay component or other means in a direction opposite to that in which such component or means is movable in response to passage of electricity through a first body of electrically conductive solid material containing gas and a multiplicity of intercommunicating volumes therein.

In another aspect of the invention the structure illustrated in FIGS. 10 and 11 may be one wherein wall 245 is of resilient material so that upon application of pressure to gas trapped above mercury 286 the wall will expand, lowering the pressure of such gas, and thereby facilitating movement of the mercury into contacting position. The presence of the resilient wall or similar means will also aid in returning the mercury to initial position upon deactivation of the switch. Thus, according to this aspect of the invention, the mercury is enclosed to prevent loss of mercury vapor to the atmosphere and part of such enclosure, which bounds a gas volume that is compressed when the relay is activated, is movable in response to the gas pressure so as to lower such pressure and thereby facilitate quick movement of the mercury and rapid closing or opening of the relay in response to such movement.

In still another aspect of this invention the relay can be operated so that on application of electricity to the reticulated conductive material the gas contained therein is expanded and this condition is the steady state of the relay, so that when the flow of electricity is interrupted the contraction of the gas changes the relay condition to closed or opened state. Although it is contemplated that development of pressure due to the flow of electricity will activate the relay and that normally electricity will not be flowing through the reticular motor except to activate it, in various applications of the general principle of this invention, especially where safety is of prime importance, the interruption of electrical flow, whether accidental or intentional, will desirably be employed to actuate a relay.

The articles of the present invention are superior to prior art thermal relays because of their quick responses to flows of primary current. Thus, prior art thermally actuated relays, wherein a heating coil is employed to heat a volume of gas to operate a motor, take much longer to transfer such heat than do the present motors. According to the Einstein-Schmolukowski Law, $t=Kx^2$, the time, t, for a gas to diffuse a given distance, x, is proportional to the square of the diffusion distance. Therefore, for quick diffusion of the gas the diffusion distance should be kept small. Heat transfer by such diffusion mechanism and pressure generation due to gas expansion are also related to diffusion and therefore, for rapid heat transfer and rapid pressure generation, such distances should be kept very small, as they are in the present motors. When one compares two cylindrical one cubic centimeter motor cells, one with a prior art heating coil in the center thereof and the other of this invention, utilizing reticulated vitreous carbon having 40 cells per centimeter (64,000 cells/cc.), the ratio of the squares of the respective diffusion distances is about 0.05, establishing that the response time of the reticulated motor to generate a given pressure is at least 20 times faster than that for the prior art heating coil example. In practice, it has been found that the advantage is even greater, apparently due to heat losses to the outside walls of the cell, transmitted by radiation and convection over the longer response time. In a pulse-type latching relay of this invention the response time of the reticulated motor is so fast that the pressure pulse can operate the latch relay contacts before there is any significant heating of the motor cell walls.

The very quick responses of the present motors and relays are primarily due to the small distances between the solid struts of the reticular motor part and the fluid contained therein. Heat transfer from the surfaces of the struts to the fluid is very fast and accordingly, expansion of the fluid is almost instantaneous. It has been found that when the average thermal diffusion distance from surfaces of solid portions of the motor to the fluid (usually a gas) contained is in the range of 2 to 300 microns, preferably 10 to 100 microns, excellent response times result and most preferably such average thermal diffusion distance is about 60 microns. Thus, in a preferred motor, useful in both miniature logic relays and large industrial relays, a typical reticulated pyrolytic carbon will contain 64,000 open cells/cc., up to 1.2 million open cell windows/cc. and up to 1.2 million interconnecting fibers/cc., 95% void space and a gas contact area of 500 sq. m./g.

The invention has been described with respect to specific illustrations and descriptions thereof but is not to be limited to these because it is evident that one having skill in the art will be able to utilize equivalents and substitutes without departing from the invention.

What is claimed is:

1. A liquid contact relay which comprises a body of solid material containing gas in a multiplicity of intercommunicating volumes therein, which body is of a sufficient resistance to the flow of electricity so that as electricity is passed through it the material thereof is heated and readily transfers heat to the gas contained therein so as to heat and expand such gas, an electrically conductive liquid which alternately completes and opens a relay circuit in different positions of such liquid, and means for operatively connecting the expandable gas of the body with the conductive liquid so that when electricity is passed through the material the gas therein is expanded and such expansion causes movement of the liquid to change the relay circuit to open or closed state from its previous condition.

2. A relay according to claim 1 wherein the body of solid material containing gas in a multiplicity of interconnecting volumes therein is of carbon.

3. A liquid relay according to claim 2 wherein such body is of a void volume of about 40 to 99% of the total volume thereof, is of porous structure containing from 10 to 100,000 pores per cubic centimeter and is of a density of 0.01 to 0.5 g./cc.

4. A relay according to claim 3 wherein the body is of reticulated vitreous carbon, the gas is hydrogen or helium and the conductive liquid is mercury.

5. A relay according to claim 1 which comprises a tube containing a slug of mercury which is in contact with the tube wall and is movable in the tube in response to a pressure difference on the mercury, electrical contact means in the tube in contact with the mercury at all times and electrical contact means in the tube in contact with the mercury when the mercury has been moved into contact position by the gas pressure, so that a relay electric current will flow through both such contact means and the mercury when the mercury has been moved into contact position, and wherein the body of solid material is enclosed in a sealed container communicating with the tube and the mercury slug and has electrical leads fastened to it so that an activating electrical current may be applied to the body of solid material.

6. A relay according to claim 4 wherein the body is of a void volume of about 90 to 99% of the total volume of such body, is of a porous structure containing 400 to 64,000 pores/cc. and is of a density of 0.03 to 0.1 g./cc.

7. A relay according to claim 6 wherein the void volume is 95 to 98% of the total volume of the body thereof, the porous body structure contains from 5,000 to 64,000 pores/cc., the density thereof is 0.03 to 0.06 g./cc. and the area per unit volume thereof is from 500 to 2,000.

8. A relay according to claim 1 comprising a body of thermally conductive material containing gas in a multiplicity of intercommunicating volumes therein, which body acts as a heat absorber so as to absorb heat from the heated and expanded gas and thereby to promote return movement of the conductive liquid upon discontinuance of flow of electricity to the electrically heated body after alteration of such circuit by movement of the conductive liquid in response to pressure generated when gas in such electrically heated body is heated.

9. A relay according to claim 8 wherein the thermally conductive reticulated body is of a sintered metal, of a void volume of about 40 to 99% of the total volume thereof, of an open pore structure containing from 10 to 100,000 pores/cc. and of a density of 0.2 to 2 g./cc.

10. A relay according to claim 9 wherein the material of the heat conductive body of solid material is aluminum, the gas in it is air, the void volume is 90 to 99%, there are 400 to 64,000 pores in it per cc., the density is 0.4 to 1 g./cc., the area:volume ratio is from 500 to 2,000 and the heat conductive body is located about an exterior surface of the electrically heatable body and is electrically insulated from it by intervening insulating material.

11. A relay according to claim 10 wherein heat conductive fins are in thermal contact with the thermally conductive recticular body material and with the surrounding atmosphere.

12. A motor, useful for activating a liquid contact relay, which comprises a body of electrically conductive solid material containing gas in a multiplicity of intercommunicating volumes therein, which body is of sufficient resistance to the flow of electricity so that as electricity is passed through it the material thereof is heated, and readily transfers heat to the gas contained therein so as to heat and expand such gas, and means for transmitting pressure developed by the expansion of such gas so that such pressure may effect movement of a relay component or other means in response to the flow of electricity through the body of solid material and to the gas pressure thereby produced.

13. A motor according to claim 12 wherein the body of solid material containing gas in a multiplicity of intercommunicating volumes therein is of carbon and such body has a void volume of about 40 to 99% of the total volume thereof, is of a porous structure containing from 10 to 100,000 pores/cc. and is of a density of 0.01 to 0.5 g./cc.

14. A motor according to claim 13 wherein the body is of reticulated vitreous carbon, the gas is hydrogen or helium, the body is of a void volume of 90 to 99% of the total volume thereof, is of a porous structure containing 400 to 64,000 pores/cc., is of a density of 0.03 to 0.1 g./cc., has an area per unit volume from 100 to 10,000, is enclosed in an otherwise sealed container communicating with an element to which pressure is to be applied upon the passage of electricity through the body and has electrical leads fastened to it so that an activating and heating electrical current may be applied to it, in response to which gas pressure is developed, which is transmitted to said element.

15. A motor according to claim 14 wherein the void volume of the body is 95 to 98% of the total volume thereof, the porous structure contains from 5,000 to 64,000 pores/cc., the density thereof is 0.03 to 0.06 g./cc. and the area per unit volume thereof is from 500 to 2,000 and which body has at a surface thereof an electrically insulating cover for at least a portion of such surface and, electrically insulated from the electrically heatable body and adjacent to such cover, a body of thermally conductive material containing a multiplicity of intercommunicating volumes therein, which thermally conductive body acts as a heat absorber so as to absorb heat from the heated and expanded gas and thereby to promote a diminution in pressure upon the discontinuance of flow of electricity to the electrically heated body.

16. A motor according to claim 15 wherein the thermally conductive reticulated body is of a sintered metal, of a void volume of about 40 to 99% of the total volume thereof, of an open porous structure containing from 10 to 100,000 pores/cc. and of a density of 0.2 to 2 g./cc.

17. A motor according to claim 16 wherein the material of the thermally conductive body is aluminum, the gas in it is air, the void volume is 90 to 99%, there are 400 to 64,000 pores/cc. in it, the density thereof is 0.4 to 1 g./cc. and the area:volume ratio is from 500 to 2,000, and the heat conductive body has heat conductive fins in thermal contact therewith and with the surrounding atmosphere.

18. A method of controlling a second electrical circuit in response to electrical flow in a first circuit which comprises passing electricity through said first circuit and through a solid body of material therein which contains gas in a multiplicity of intercommunicating volumes therein, which body is conductive of electricity and of a sufficient resistance to the flow thereof that as electricity is passed through it the material of the body is heated and transfers heat to the gas contained therein so as to heat and expand such gas and develop a pressure, and communicating such pressure to pressure responsive means in such second circuit for opening or closing such circuit.

19. A method according to claim 18 wherein the body of solid material containing gas in a multiplicity of interconnecting volumes therein is reticulated vitreous carbon, the gas is hydrogen or helium and the body is of a void volume of about 90 to 99% of the total volume of such body, is of a porous structure containing 400 to 64,000 pores/cc. and is of a density of 0.03 to 0.1 g./cc.

20. A method according to claim 19 wherein, after activation or deactivation of the second circuit in response to the pressure generated by passage of electricity through the body of the first circuit and generation of heat and pressure thereby, said heat and pressure are diminished by absorbing the heat with a thermally conductive material adjacent to the heat generating material, which thermally conductive material is capable of dissipating heat therefrom to the atmosphere or other suitable heat sink.

21. A method of applying pressure to an object or material in response to the passage of electricity through means separate from such material or object which comprises passing electricity through an electrical circuit and through a solid body of material therein, which material contains gas in a multiplicity of intercommunicating volumes therein and which is conductive of electricity and of sufficient resistance to the flow thereof that as electricity is passed through it the material of the body is heated and transfers heat to the gas contained therein so as to heat and expand such gas, containing the heated and expanded gas in a container located about the body and transmitting the pressure developed in such container to said separate object or material.

22. A method according to claim 21 wherein the body of solid material containing gas and a multiplicity of intercommunicating volumes therein is reticulated vitreous carbon, the gas is hydrogen or helium and the body is of a void volume of 90 to 99% of the total volume of such body, is of a pore structure containing 400 to 64,000 pores/cc. and is of a density of 0.03 to 0.1 g./cc.

23. A method according to claim 22 wherein after development of the pressure generated by passage of electricity through the body of reticulated vitreous carbon and generation of heat and pressure thereby, said heat and pressure are diminished by absorbing the heat with a thermally conductive material adjacent to the heat generating material and transferring heat from the thermally conductive material to the atmosphere or other suitable heat sink.

24. A motor according to claim 12 wherein the body of electrically conductive solid material containing gas in a multiplicity of intercommunicating volumes therein is a body of non-conductive solid material having a conductive material present therewith in such quantity and in such regular distribution as to make such body electrically conductive and of such a resistance to the flow of electricity so that as electricity is passed through it the material thereof is heated.

25. A motor according to claim 24 wherein the non-conductive body is of a ceramic material and the conductive material thereon is a metal or conductive metal oxide.

26. A liquid contact relay according to claim 1 wherein the body of electrically conductive solid material containing gas in a multiplicity of intercommunicating volumes therein is a body of non-conductive solid material having a conductive material present therewith in such quantity and in such regular distribution as to make such body electrically conductive and of such a resistance to the flow of electricity so that as electricity is passed through it the material thereof is heated.

27. A relay according to claim 26 wherein the non-conductive body is of a ceramic material and the conductive material thereon is a metal or conductive metal oxide.

28. A motor, useful for activating a liquid contact relay, which comprises a body of electrically conductive solid material containing a volatilizable liquid in a multiplicity of intercommunicating volumes therein, which body is of sufficient resistance to the flow of electricity so that as electricity is passed through it the material thereof is heated and readily transfers heat to the volatilizable liquid contained therein so as to heat such liquid and convert at least a part thereof to a gas, and means for transmitting pressure developed by the change of state of the liquid to a gas so that such pressure may effect movement of a relay component or other means in response to the flow of electricity through the body of solid material and in response to the gas pressure thereby produced.

29. A liquid contact relay which comprises a body of solid material containing a volatilizable liquid in a multiplicity of intercommunicating volumes therein, which body is of a sufficient resistance to the flow of electricity so that as the electricity is passed through it the material thereof is heated and readily transfers heat to the volatilizable liquid contained therein so as to vaporize such liquid, an electrically conductive liquid which alternately completes and opens a relay circuit in different positions of such liquid, and means for operatively connecting the gas resulting from such change of state, due to heating of the volatilizable liquid, with the conductive liquid so that when electricity is passed through the material the gas so produced causes movement of the conductive liquid to change the relay circuit to open or closed position from its previous position.

30. A liquid contact relay according to claim 1 wherein the electrically conductive liquid and the relay circuit which is alternately openable and closable include a pair of mercury pools, one of which has a portion thereof moved into contact with the other of which by the pressure generated by heating of the body of solid material.

31. A liquid contact relay according to claim 30 wherein one of the pools is surrounded by the other, the inner pool is divided into inner and outer sections so that gas pressure applied to the surface of the inner section of said pool acts to move the material thereof away from the point of application of such pressure and thereby moves such liquid contact material in the outer portion of the inner pool in the opposite direction and into contact with such material in the outer pool.

32. A relay according to claim 8 wherein the thermally conductive material is selected from the group consisting of silver, copper, silicon nitride, boron nitride, beryllium oxide and diamond dust in a beryllium oxide hydrate binder.

33. A liquid relay according to claim 1 which comprises a second body of solid material containing gas in a multiplicity of intercommunicating volumes therein, which, upon the passage of electricity through it, operates to move the conductive liquid in a direction opposite to that in which it is moved by the passage of electricity through the first body of solid material.

34. A motor according to claim 12 which comprises a second body of electrically conductive solid material containing gas in a multiplicity of intercommunicating volumes therein, which body is so located that upon passage of electricity through it the gas pressure developed tends to move the relay component or other means in a direction opposite to that in which such component or means is movable in response to passage of electricity through the first body of electrically conductive solid material.

35. A relay according to claim 31 wherein the mercury is enclosed to prevent loss of mercury vapor to the atmosphere and part of such enclosure bounds a gas volume which is compressed when the relay is activated and is movable in response to the gas pressure so as to lower such pressure and thereby facilitate quick movement of the mercury and rapid closing or opening of the relay in response to such movement.

36. A liquid contact relay which comprises a body of solid material containing gas in a multiplicity of intercommunicating volumes therein, which body is of a sufficient resistance to the flow of electricity so that as electricity is passed through it the material thereof is heated and readily transfers heat to the gas contained therein so as to heat and expand such gas, an electrically conductive liquid which alternately opens and completes a relay circuit in different positions of such liquid, and means for operatively connecting the expandable gas of the body with the conductive liquid so that when electricity is passed through the material the gas therein holds a relay in open or closed state and when such flow of electricity is interrupted the gas contracts and causes movement of the liquid to change the relay circuit to a different closed or opened state from its previous condition.

37. An electrothermal relay comprising at least one electrical contact connected to and controlling a controlled electrical circuit, an enclosure, with external heat exchange means, a heating element in said enclosure and containing interconnected microscopically sized heating element components which are electrically conductive and resistive, a fluid filling said enclosure in space between said heater element components, means connecting said fluid to said contact, said heating elements being so interconnected and dispersed throughout said enclosure so that essentially all of said fluid is within a microscopic distance of such a heating element component, means for applying an electrical voltage difference of a controlling circuit to said heating element, to cause by electrical heating effect a thermally induced pressure increase in said fluid, thereby causing said fluid to flow and actuating said electrical contact, said heating elements being so relatively small compared to the size of the void volume between said heater elements that the impedance to flow of said fluid is essentially nil, enabling the speeds of response of fluid flow and contact movement in the control circuit to respond rapidly and accurately follow controlling circuit stimuli.

38. An electrothermal relay comprising at least one electrical contact connected to at least one controlled circuit, whereby the movement of said contact opens and closes the controlled circuit, an enclosure with an external heat exchanger, which enclosure contains a heating element with parts thereof of microscopic size and interconnected, which is electrically conductive and resistive, and structurally self supporting, a fluid in said enclosure located in the spacing between said heating elements, means for transmitting an electrical controlling voltage difference of a controlling circuit to said heating element, which causes, by electrical heat effect, the generation of thermally induced pressure and flow in said fluid, means connecting said fluid to said contact, said heating element being of such a size and separation that said fluid maintains a constant temperature throughout said enclosure in a convection-free manner, and said contacts move as a result of fluid flow and pressure transmission in such a manner as to faithfully follow pressure changes in the enclosure in a close time relationship.

* * * * *